US007746296B2

(12) United States Patent
Park et al.

(10) Patent No.: US 7,746,296 B2
(45) Date of Patent: Jun. 29, 2010

(54) PLASMA DISPLAY APPARATUS AND DRIVING METHOD THEREOF

(75) Inventors: Kirack Park, Gyeongsangbuk-do (KR); Seonghwan Ryu, Gumi-si (KR)

(73) Assignee: LG Electronics Inc., Seoul (KR)

( * ) Notice: Subject to any disclaimer, the term of this patent is extended or adjusted under 35 U.S.C. 154(b) by 725 days.

(21) Appl. No.: 11/619,643

(22) Filed: Jan. 4, 2007

(65) Prior Publication Data

US 2007/0152914 A1 Jul. 5, 2007

(30) Foreign Application Priority Data

Jan. 4, 2006 (KR) ..... 10-2006-0001139

(51) Int. Cl.
*G09G 3/28* (2006.01)

(52) U.S. Cl. ..... 345/60; 345/66

(58) Field of Classification Search ..... 345/60–67, 345/203, 211; 315/169.1–169.4; 313/581–584, 313/590

See application file for complete search history.

(56) References Cited

U.S. PATENT DOCUMENTS

| | | | | |
|---|---|---|---|---|
| 6,104,361 | A | 8/2000 | Rutherford | |
| 6,456,264 | B1 * | 9/2002 | Kang et al. | 345/63 |
| 7,535,438 | B2 * | 5/2009 | Takeuchi et al. | 345/63 |
| 2001/0011973 | A1 * | 8/2001 | Kang et al. | 345/60 |
| 2002/0084961 | A1 * | 7/2002 | Acosta et al. | 345/87 |
| 2004/0113871 | A1 | 6/2004 | Kashio | |
| 2004/0155836 | A1 | 8/2004 | Kim | |
| 2005/0156824 | A1 * | 7/2005 | Okamoto et al. | 345/60 |
| 2005/0264488 | A1 | 12/2005 | Kim | |
| 2006/0103594 | A1 * | 5/2006 | Kim et al. | 345/60 |
| 2006/0176246 | A1 * | 8/2006 | Shoji et al. | 345/60 |

FOREIGN PATENT DOCUMENTS

| | | | |
|---|---|---|---|
| EP | 0 853 306 | A1 | 7/1998 |
| EP | 0 855 692 | A1 | 7/1998 |
| JP | 08-305319 | | 11/1996 |
| JP | 2001-202060 | A | 7/2001 |
| KR | 10-2004-0065711 | | 7/2004 |
| KR | 10-2004-0091878 | | 11/2004 |

OTHER PUBLICATIONS

European Search Report dated Aug. 6, 2009 for Application No. 07250018.4, 11 pages.

Korean Intellectual Property Office Notice of Decision to Grant a Patent for Application No. 10-2006-0001139 dated Nov. 5, 2007, 3 pages (with English translation).

* cited by examiner

*Primary Examiner*—Nitin Patel
(74) *Attorney, Agent, or Firm*—Fish & Richardson P.C.

(57) ABSTRACT

A plasma display apparatus and a method of driving the same are provided. The plasma display apparatus comprises a plasma display panel, a scan driver, and a data driver. The plasma display panel comprises a scan electrode, a sustain electrode, a first address electrode, and a second address electrode. The scan driver supplies a pulse to the scan electrode between a reset period and an address period. The data driver supplies a data pulse to the first address electrode and the second address electrode at different points of time.

20 Claims, 22 Drawing Sheets

PLASMA DISPLAY APPARATUS AND DRIVING METHOD THEREOF

This Nonprovisional application claims priority under 35 U.S.C. §119(a) on Patent Application No. 10-2006-0001139 filed in Korea on Jan. 4, 2006 the entire contents of which are hereby incorporated by reference.

BACKGROUND

1. Field

This document relates to a plasma display apparatus and a method of driving the same.

2. Related Art

In general, a plasma display apparatus has a plasma display panel, and drivers for supplying driving signals to electrodes of the plasma display panel.

In the plasma display panel, a barrier rib formed between a front substrate and a rear substrate forms one unit cell. Each cell is filled with an inert gas containing a main discharge gas, such as neon (Ne), helium (He), and a mixed gas of Ne+He, and a small amount of xeon.

When discharge is generated as a high frequency voltage is applied to electrodes, the inert gas generates vacuum ultraviolet rays. The vacuum ultraviolet rays emit phosphors formed between the barrier ribs, so that images are implemented. The plasma display apparatus can be made light and thin and thus has been in the spotlight as next-generation display devices.

If the drivers of the plasma display apparatus supply the driving signals to the electrodes of the plasma display panel, wall charges are formed on the electrodes of the plasma display panel. Images are displayed by wall voltage formed by the wall charges and external voltage supplied to the electrodes.

SUMMARY

A plasma display apparatus comprises a plasma display panel comprising a scan electrode, a sustain electrode, a first address electrode, and a second address electrode, a scan driver supplying a pulse to the scan electrode between a reset period and an address period, and a data driver supplying a data pulse to the first address electrode and the second address electrode at different points of time.

A method of driving a plasma display apparatus comprises a scan electrode, a sustain electrode, a first address electrode, and a second address electrode, the method comprising, supplying a pulse to the scan electrode between a reset period and an address period and supplying a data pulse to a first address electrode and a second address electrode at different points of time in the address period.

BRIEF DESCRIPTION OF THE DRAWINGS

The implementation of this document will be described in detail with reference to the following drawings in which like numerals refer to like elements.

DETAILED DESCRIPTION

Hereinafter, an implementation of this document will be described in detail with reference to the attached drawings.

Figure 1:
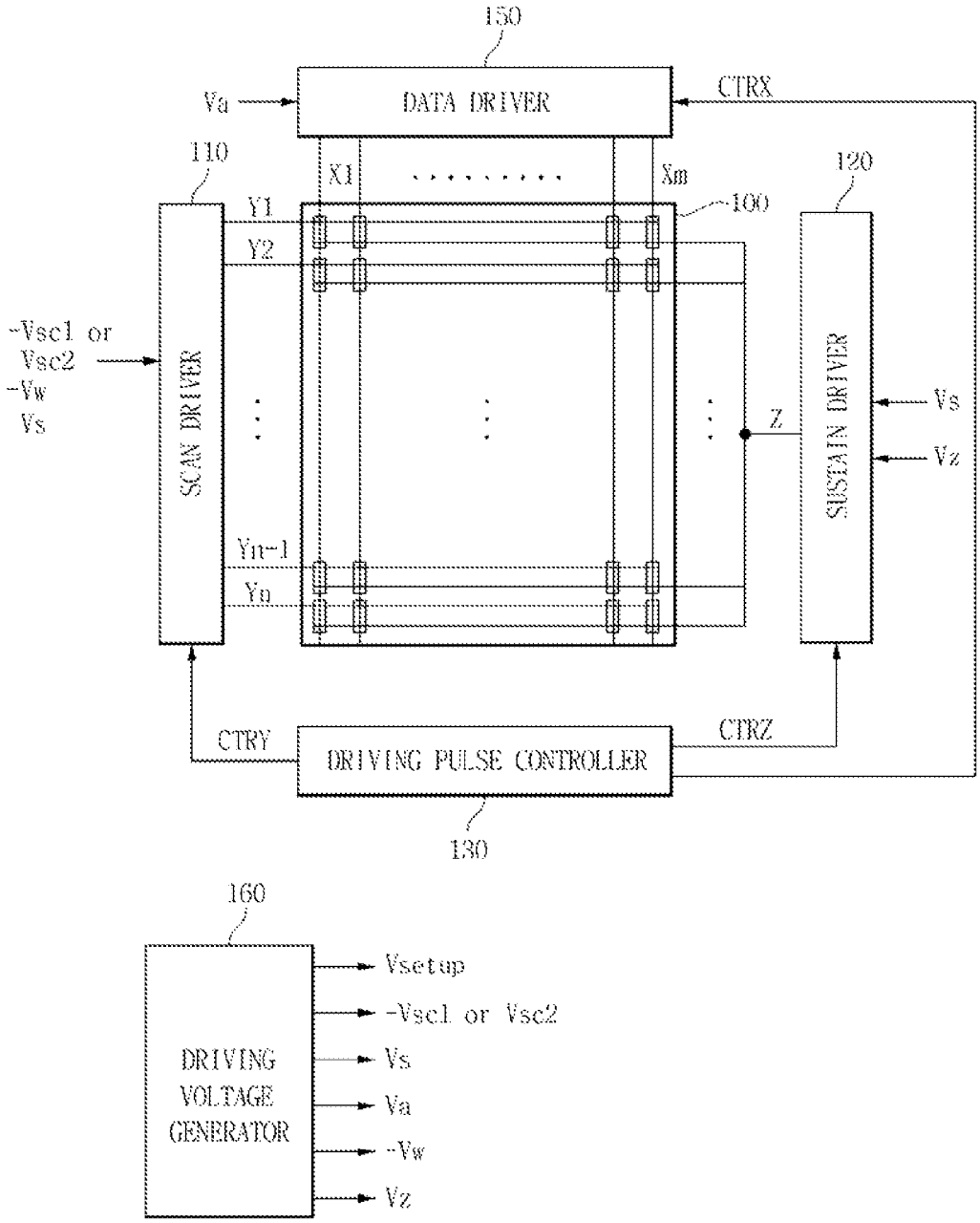
FIG. 1 is a view illustrating a plasma display apparatus according to an embodiment of this document.

A plasma display apparatus according to a first embodiment of this document as illustrated in FIG. 1 comprises a plasma display panel 100, a scan driver 110, a sustain driver 120, a driving pulse controller 130, a driving voltage generator 140, and a data driver 150.

The scan driver 110 supplies a pulse to a scan electrode between a reset period and an address period. For example, the scan driver 110 can supply a falling pulse, which falls from a first voltage to a second voltage of a negative polarity, and a first rising pulse, which rises from a third voltage to a fourth voltage of a positive polarity, to scan electrodes Y1 to Yn between the reset period and the address period. The scan driver 110 may supply only the falling pulse or sequentially supply the falling pulse and the first rising pulse between the reset period and the address period. The scan driver 110 can supply a third rising pulse, which rises from a seventh voltage to an eighth voltage, and a second falling pulse, which falls from a ninth voltage to a tenth voltage, to the scan electrodes Y1 to Yn.

The scan driver 110 supplies a sustain pulse to the scan electrodes Y1 to Yn in a sustain period posterior to the address period.

The first falling pulse and the second falling pulse are supplied to erase wall charges, which have been excessively accumulated on address electrodes X1 to Xn of a discharge cell of the plasma display panel. The first rising pulse and the third rising pulse are pulses for erasing wall charges excessively accumulated on the scan electrodes Y1 to Yn and the sustain electrode Z.

The sustain driver 120 supplies a fifth voltage of a positive polarity to the sustain electrode Z when the first falling pulse is supplied or supply voltage of a ground level to the sustain electrode Z when the second falling pulse is supplied. The sustain driver 120 supplies a bias voltage Vz to the sustain electrode Z in the address period. The sustain driver 120 supplies a sustain pulse to the sustain electrode Z alternately with the sustain pulse supplied to the scan driver 110 in the sustain period posterior to the address period. Vs is the highest voltage of the sustain pulse.

The scan driver 110 supplies a scan reference voltage −Vsc1 or Vsc2 and the scan pulse in the address period. −Vw is the lowest voltage of the scan pulse.

The data driver 150 supplies a data pulse to the first address electrode and the second address electrode at different points of time. The first address electrode and the second address electrode are two different address electrodes of the entire address electrodes X1 to Xm shown in FIG. 1. Va is the highest voltage of the data pulse.

The driving pulse controller 130 controls the scan driver 110, the sustain driver 120, and the data driver 150 when the plasma display panel 100 is driven. That is, the driving pulse controller 130 generates timing control signals CTRX, CTRY, and CTRZ for controlling operating timing and synchronization of the scan driver 110, the sustain driver 120, and the data driver 150 in the reset period, the address period, and the sustain period.

The driving voltage generator 160 supplies driving voltages −Vsc1 or Vsc2, Vs, Va, −Vw, and Vz necessary for the driving pulse controller 130 and the respective drivers 110, 120, and 150.

Figure 2:
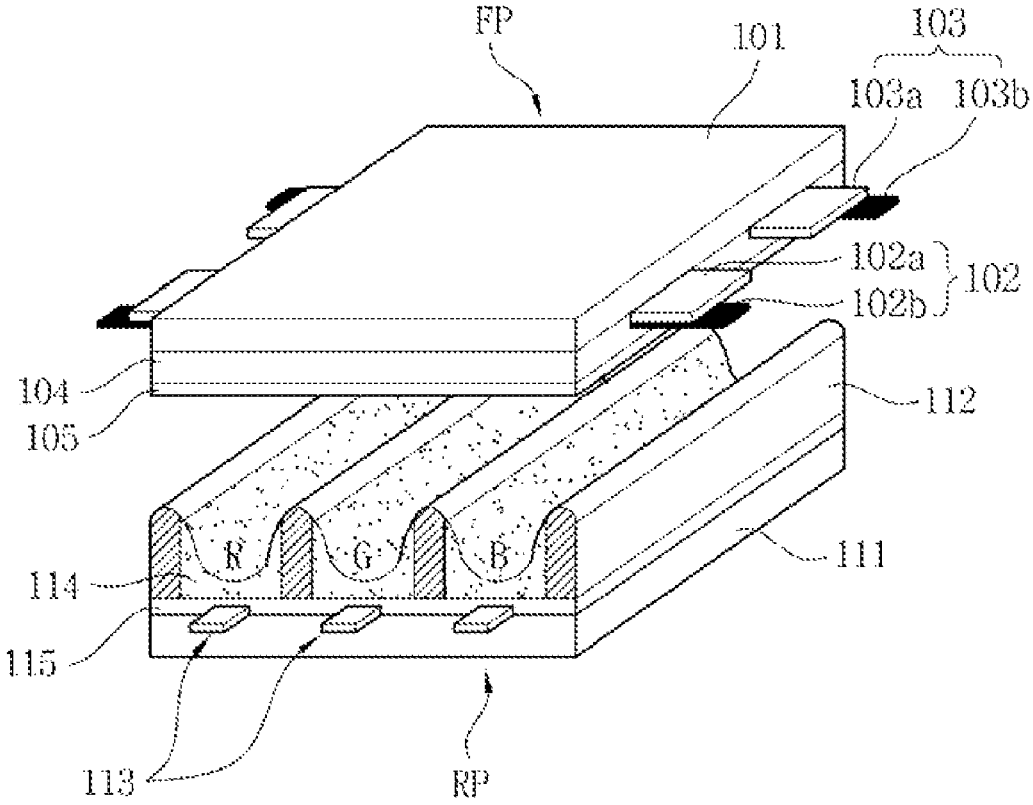
FIG. 2 is a view illustrating a plasma display panel of a plasma display apparatus according to an embodiment of this document.

The plasma display panel 100 of the plasma display apparatus according to an embodiment of this document as illustrated in FIG. 2 comprises a front panel FP and a rear panel RP.

A scan electrode 102 and a sustain electrode 103 are formed in pairs in a front substrate 101 of the front panel FP. Address electrodes 113 crossing the scan electrode 102 and the sustain electrode 103 are arranged in a rear substrate 111 of the rear panel RP. The front panel FP and the rear panel RP are parallel to each other with a specific distance therebetween.

The scan electrode 102 and the sustain electrode 103 comprise transparent electrodes 102*a* and 103*a* and bus electrodes 102*b* and 103*b*, respectively. An upper dielectric layer 104 limits discharge currents of the scan electrode 102 and the sustain electrode 103 and insulates the electrode pairs. The protection layer 105 is disposed on a top surface of the upper dielectric layer 104, and emits secondary electrons.

The address electrodes 113 for causing address discharge are disposed on the rear substrate 111 of the rear panel RP. A lower dielectric layer 115 protects the address electrodes 113 and insulates the address electrodes 113. A barrier rib 112 partitions the discharge cell. R, G, and B phosphors 114 are disposed between the barrier ribs 112, and radiate a visible ray.

Only an example of the plasma display panel, which is one of driving elements of the plasma display apparatus of this document, has been shown and described in FIG. 2. However, it is to be noted that this document is not limited to the structure of FIG. 2.

For example, it has been shown in FIG. 2 that the scan electrode 102 and the sustain electrode 103 are formed in the front panel FP and the address electrodes 113 are formed in the rear panel RP. However, the scan electrode 102, the sustain electrode 103, and the address electrodes 113 may be all formed in the front panel FP. Alternatively, the scan electrode 102 and the sustain electrode 103 may comprise the transparent electrodes 102*a* and 103*a* and the bus electrodes 102*b* and 103*b*, or comprise only the bus electrodes 102*b* and 103*b*, respectively.

Figure 3:
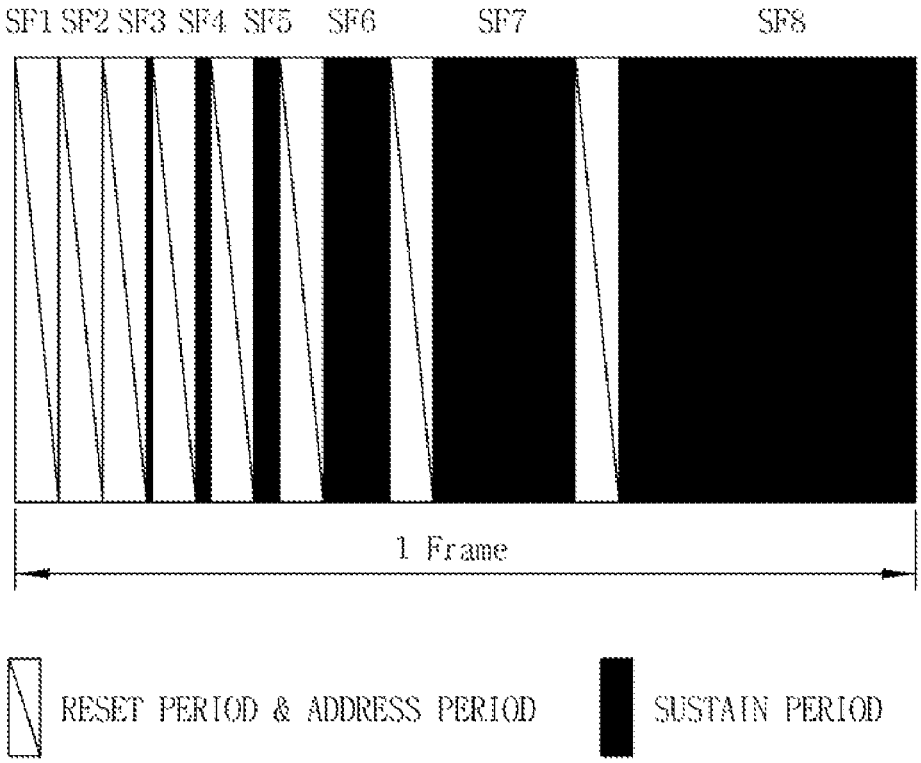
FIG. 3 is a view illustrating a method of representing gray levels of a plasma display apparatus according to an embodiment of this document.

As illustrated in FIG. 3, the plasma display apparatus according to an embodiment of this document displays an image every subfield constituting a frame. Each subfield comprises a reset period for resetting a discharge cell, an address period for selecting a discharge cell, and a sustain period where light is radiated from a selected discharge cell. In FIG. 3, one frame may comprise eight subfields SF1 to SF8, or one frame may comprise 10 or 12 subfields.

Figure 4A:
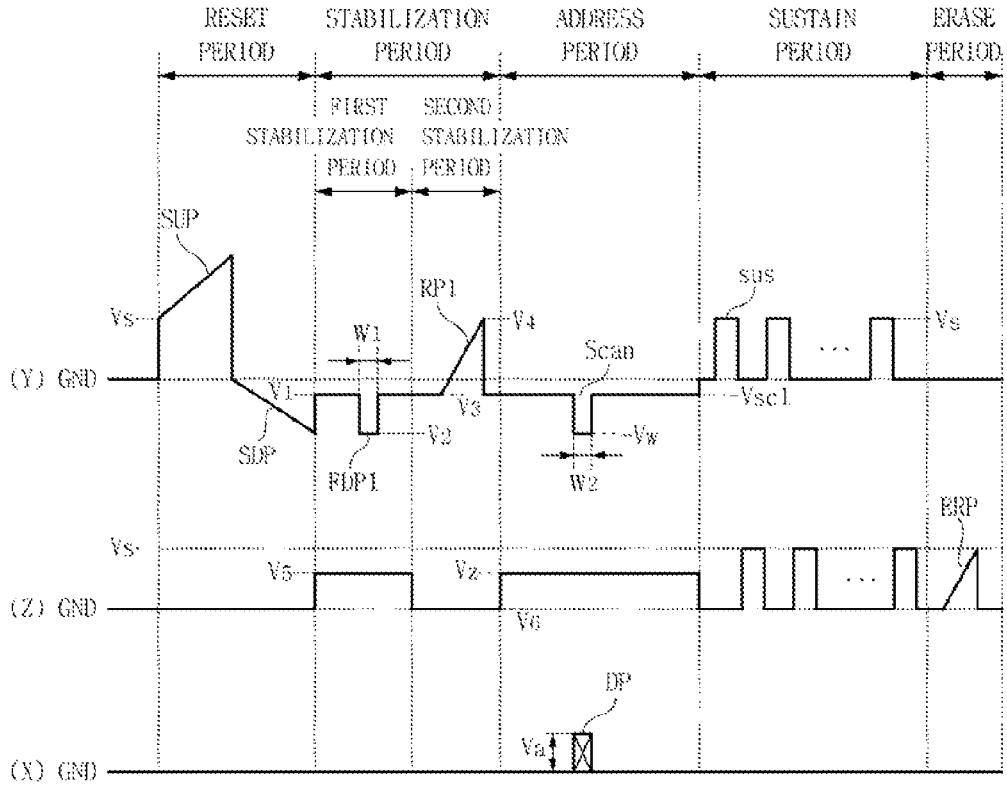
FIG. 4*a* illustrates a first waveform of a driving signal of the plasma display apparatus according to an embodiment of this document.

As illustrated in FIG. 4*a*, the scan driver 110 of FIG. 1 supplies a set-up pulse SUP, rising from the sustain voltage Vs, and a set-down pulse SDP, falling from voltage of a ground level GND, to the scan electrode Y in the reset period. Weak dark discharge is generated in discharge cells by means of the set-up pulse SUP. The set-up pulse SUP causes positive wall charges to be accumulated on the address electrode X and the sustain electrode Z and negative wall charges to be accumulated on the scan electrode Y. The set-down pulse SDP causes an erase discharge to occur between the scan electrode Y and the address electrode X.

A stabilization period comprises a first stabilization period and a second stabilization period. The scan driver 110 supplies a first falling pulse FDP1, which falls from a first voltage V1 to a second voltage V2, to the scan electrode Y in the first stabilization period. The first falling pulse FDP1 causes some degree of wall charges, which have been formed between the scan electrode Y and the sustain electrode Z, to be erased.

The first falling pulse FDP1 may be a square wave. The level of the first voltage V1 of the first falling pulse FDP1 may be substantially the same as the scan reference voltage −Vsc1 applied to the scan electrode Y during the address period. The level of the scan reference voltage −Vsc1 may be from −90V or higher to −70V or less. The level of the second voltage V2 of the falling pulse FPD may be substantially the same as that of the lowest voltage −Vw of a scan pulse Scan supplied to the scan electrode Y during the address period. The level of the second voltage V2 of the first falling pulse FDP1 may be from −210V or higher to −190V or less. A width w1 of the first falling pulse FDP1 may be substantially the same as or wider than a width w2 of the scan pulse Scan. The width w1 of the first falling pulse FDP1 may be in the range of 1 to 10 μs.

While the first falling pulse FDP1 is supplied, the sustain driver 120 of FIG. 1 supplies the fifth voltage V5 to the sustain electrode Z. In an embodiment of this document, the level of the fifth voltage V5 may be substantially the same as that of a bias voltage Vz. In an embodiment of this document, the level of the fifth voltage V5 may be in the range of 80V to 100V. In an embodiment of this document, the level of the fifth voltage V5 may be higher than that of a sixth voltage V6 supplied to the sustain electrode Z when the first rising pulse RP1 is supplied.

In an embodiment of this document, the scan driver 110 can supply a first rising pulse RP1, which gradually rises from a third voltage V3 to a fourth voltage V4, to the scan electrode Y after the first falling pulse FDP1 is supplied. The level of the third voltage V3 may be substantially the same as that of the scan reference voltage −Vsc1. The level of the fourth voltage V4 may be substantially the same as that of the highest voltage Vs of a sustain pulse sus. In an embodiment of this document, the level of the fourth voltage V4 may be in the range of 150V to 250V. When the level of the fourth voltage V4 is in the range of 150V to 250V, wall charges that can generate stable address discharge in the scan electrode Y and the sustain electrode Z uniformly remain within discharge cells.

While the first rising pulse RP1 is supplied, the sustain driver 120 can supply the sixth voltage V6 of the ground level to the sustain electrode Z.

In the address period, the scan driver 110 supplies the scan pulse Scan to the scan electrode Y, and the data driver 150 supplies a data pulse DP to the address electrode X. Address discharge is generated by the data pulse DP and the scan pulse Scan of a high level. Further, the sustain driver 120 supplies the bias voltage Vz in the address period in order to make smooth the address discharge with the scan electrode Y and the address electrode X.

The scan driver 110 and the sustain driver 120 alternatively applies the sustain pulse sus to the scan electrode Y and the sustain electrode Z in the sustain period. Accordingly, sustain discharge is generated in discharge cells selected in the address period.

The sustain driver 120 supplies an erase pulse ERP in the erase period. Accordingly, wall charges remaining within discharge cells are erased.

Figure 4B:
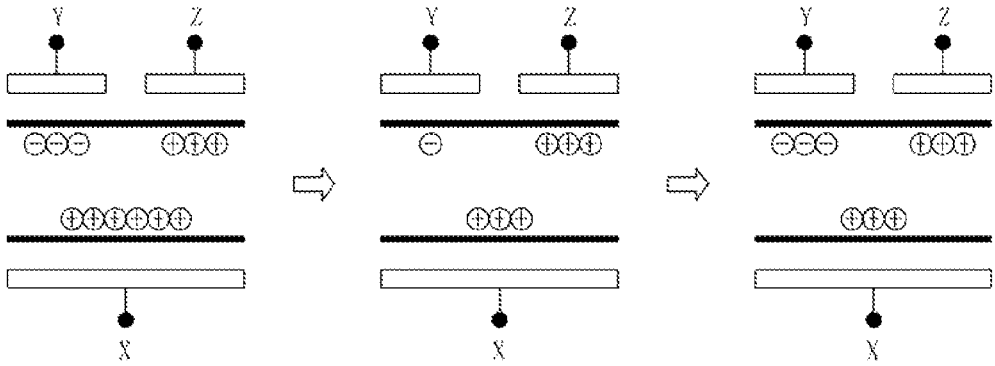
FIG. 4*b* illustrates a wall charge state in accordance with the driving signal of the plasma display apparatus according to an embodiment of this document.

If the set-down pulse SDP is supplied in the reset period of FIG. 4*a*, negative wall charges − are formed on the scan electrode Y and positive wall charges + are formed on the address electrode X, as illustrated on a left side of FIG. 4*b*.

If the first falling pulse FDP1 is supplied of FIG. 4*a*, some of the negative wall charges − formed on the scan electrode Y and some of the positive wall charges + formed on the address electrode X are erased, as illustrated at the center of FIG. 4*b*.

If the first rising pulse RP1 is supplied of FIG. 4*a*, wall charges of the degree that address discharge can occur stably uniformly remain on the scan electrode Y and the sustain electrode Z, as illustrated on a right side of FIG. 4*b*. Therefore, erroneous discharge of a spot can be prevented at the time of address discharge.

Figure 5:
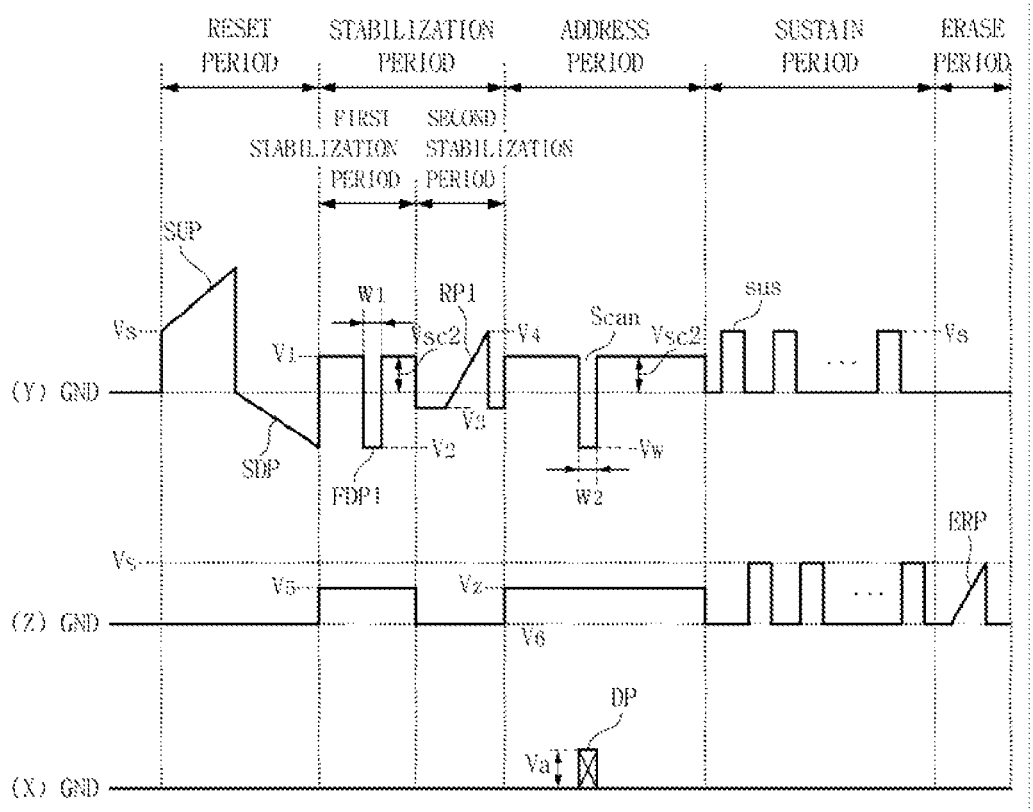
FIG. 5 illustrates a second waveform of the driving signal of the plasma display apparatus according to an embodiment of this document.

As illustrated in FIG. 5, driving pulses supplied in the reset period, the sustain period, and the erase period of a second waveform of the driving signal of the plasma display apparatus according to an embodiment of this document may be the same as those of FIG. 4*a*.

The scan driver 110 can supply a first falling pulse FDP1 , which falls from a first voltage V1 to a second voltage V2, to the scan electrode Y in the first stabilization period of FIG. 5. The first voltage V1 of FIG. 4*a* is a negative voltage, whereas the first voltage V1 of FIG. 5 is a positive voltage. The level of the first voltage V1 of FIG. 5 may be substantially the same as that of a scan reference voltage Vsc2 of the address period. The level of the first voltage V1 of FIG. 5 may be in the range of 50V to 80V. The level of the second voltage V2 of FIG. 5 may be from −70V or higher to −40V or less. Further, the level of the third voltage V3 of the first rising pulse RP1 may be from −10V or higher to 10V or less. Accordingly, wall charges can be erased properly depending on the amount of wall charges accumulated on the address electrode X.

Figure 6:
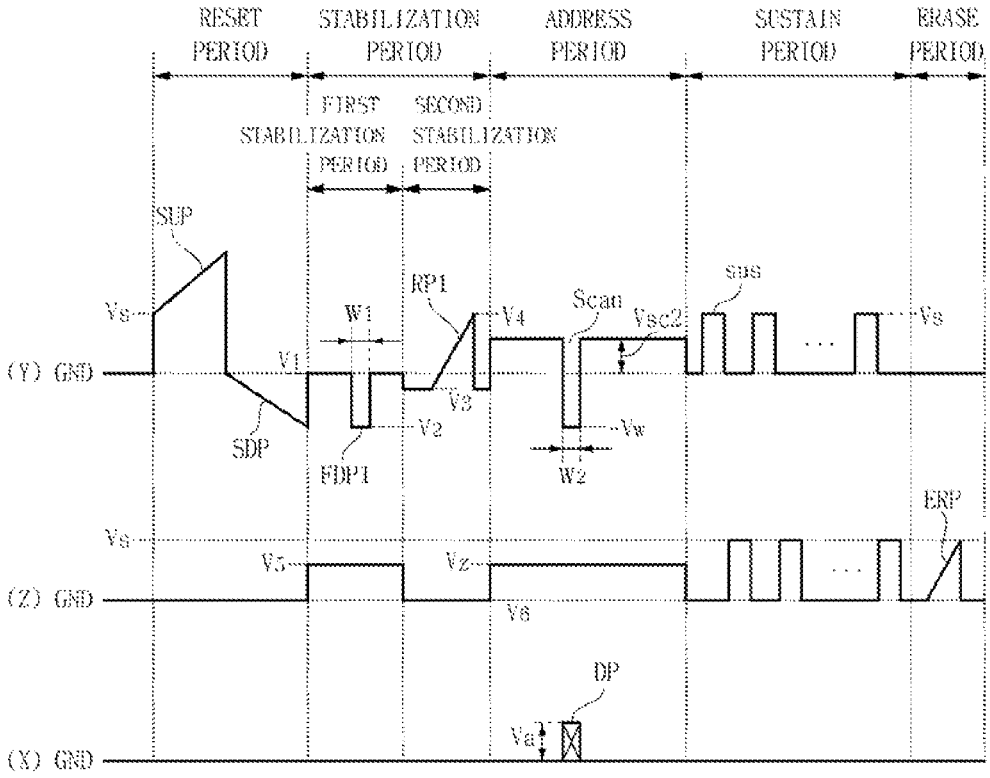
FIG. 6 illustrates a third waveform of the driving signal of the plasma display apparatus according to an embodiment of this document.

As illustrated in FIG. 6, driving pulses supplied in the reset period, the sustain period, and the erase period of a third waveform of the driving signal of the plasma display apparatus according to an embodiment of this document are the same as those of FIG. 4*a*.

In the first stabilization period of FIG. 6, the scan driver 110 supplies the first falling pulse FDP1 and the first rising pulse RP1. The level of the first voltage V1 and the third voltage V3 of FIG. 6 may range from −10V or higher to 10V or less. Accordingly, wall charges can be properly erased depending on the amount of wall charges accumulated on the address electrode X.

Figure 7:
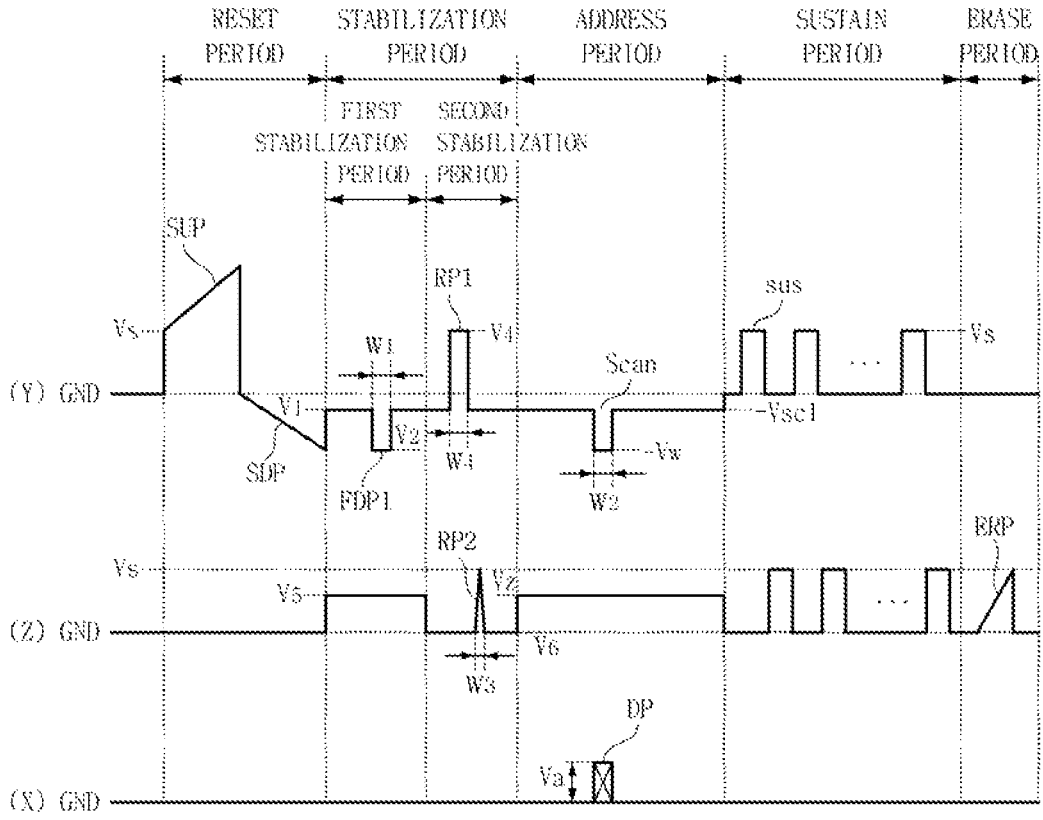
FIG. 7 illustrates a fourth waveform of the driving signal of the plasma display apparatus according to an embodiment of this document.

As illustrated in FIG. 7, the scan driver 110 supplies the first falling pulse FDP1 and the first rising pulse RP1 to the scan electrode Y in the first stabilization period and the second stabilization period. The level of the first voltage V1 of the first falling pulse FDP1 and the level of the third voltage V3 of the first rising pulse RP1 are substantially the same as that of the scan reference voltage −Vsc1. The level of the scan reference voltage −Vsc1 may be from −90V or higher to −70V or less. The level of the second voltage V2 of the first falling pulse FDP1 may be substantially the same as that of the lowest voltage −Vw of the scan pulse Scan. The level of the second voltage V2 of the first falling pulse FDP1 may range from −210V or higher to −190V or less. A width w1 of the first falling pulse FDP1 may be substantially the same as or wider than a width w2 of the scan pulse Scan. The width w1 of the first falling pulse FDP1 may be in the range of 1 μs to 10 μs.

The width w1 of the first falling pulse FDP1 and the level of the second voltage V2 of FIG. 7 can be controlled by properly erasing some of negative wall charges of the scan electrode Y and positive wall charges of the address electrode X.

After the first falling pulse FDP1 is supplied, the scan driver 110 can supply the first rising pulse RP1 of a square wave. The level of the third voltage V3 of the first rising pulse RP1 may be substantially the same as that of the scan reference voltage −Vsc1. Further, the level of the fourth voltage V4 of the first rising pulse RP1 may be substantially the same as that of the sustain voltage Vs. The level of the fourth voltage V4 may range from 150V to 250V.

The sustain driver 120 supplies the second rising pulse RP2 to the sustain electrode Z alternately with the first rising pulse RP1 in the second stabilization period. The level of the highest voltage of the second rising pulse RP2 may be substantially the same as that of the sustain voltage Vs. The level of the highest voltage of the second rising pulse RP2 may be in the range of 150V to 250V. A width w3 of the second rising pulse RP2 may be smaller than the width w1 of the falling pulse and a width w4 of the first rising pulse RP1. The width w3 of the second rising pulse RP2 may be equal to or less than 50 ns and equal to or more than 500 ns.

Figure 8A:
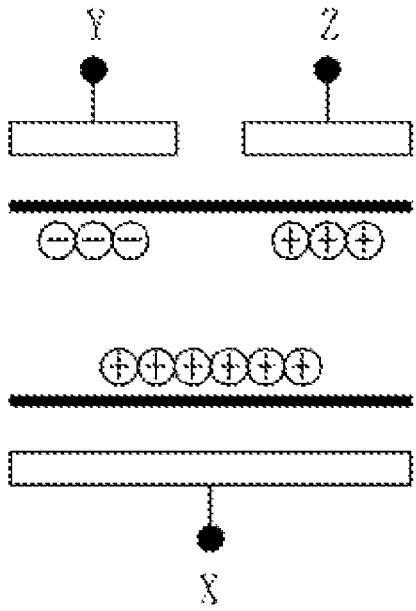
FIGS. 8*a* to 8*d* illustrate wall charge states in accordance with the fourth waveform of the driving signal of the plasma display apparatus according to an embodiment of this document.

During the set-down period of the reset period, negative wall charges − are formed on the scan electrode Y and positive wall charges + are formed on the address electrode X, as illustrated in FIG. 8*a*.

Figure 8B:
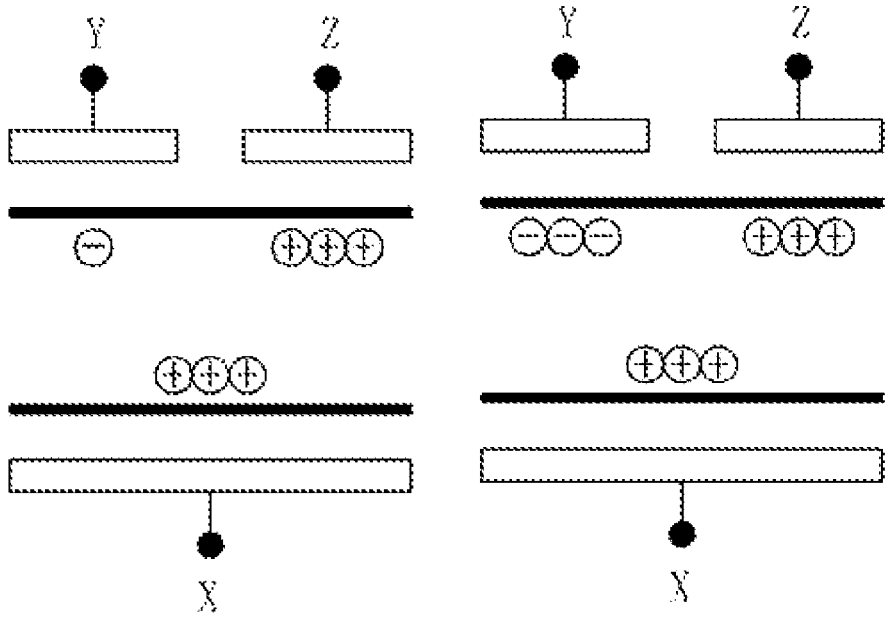

If the first falling pulse FDP1 is supplied to the scan electrode Y, some of the negative wall charges − of the scan electrode Y and the positive wall charges + of the address electrode X are erased, as illustrated in FIG. 8*b*.

Figure 8C:
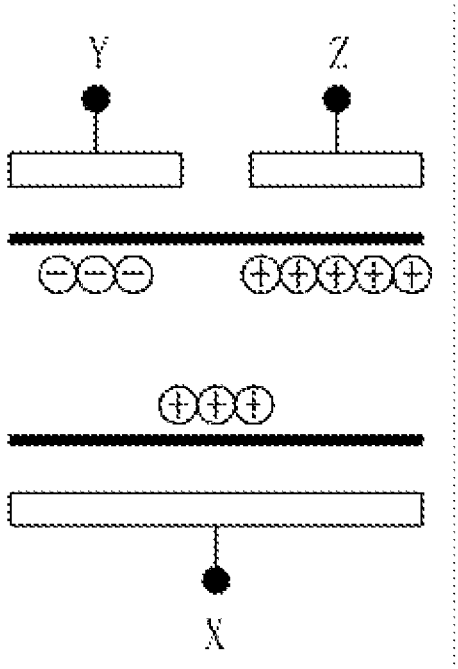

If the first rising pulse RP1 is supplied to the scan electrode Y and the second rising pulse RP2 is supplied to the sustain electrode Z, some of wall charges excessively formed on the scan electrode Y and the sustain electrode Z are erased, as illustrated in FIG. 8*c*.

Figure 8D:
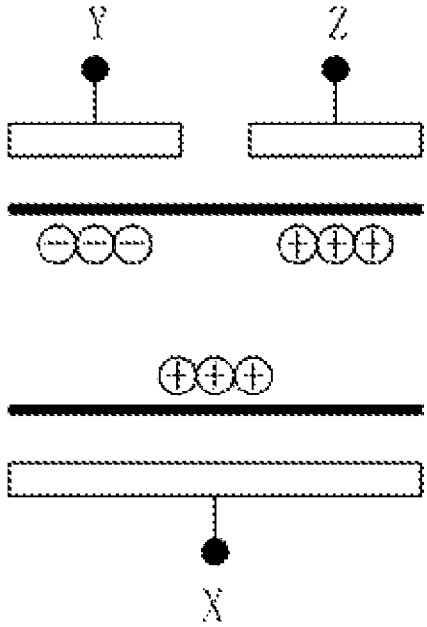

Wall charges of the degree in which address discharge can be generated stably uniformly remain on the scan electrode Y and the sustain electrode Z within discharge cells, as illustrated in FIG. 8*d*. Accordingly, erroneous discharge of a spot can be prevented at the time of address discharge.

Figure 9:
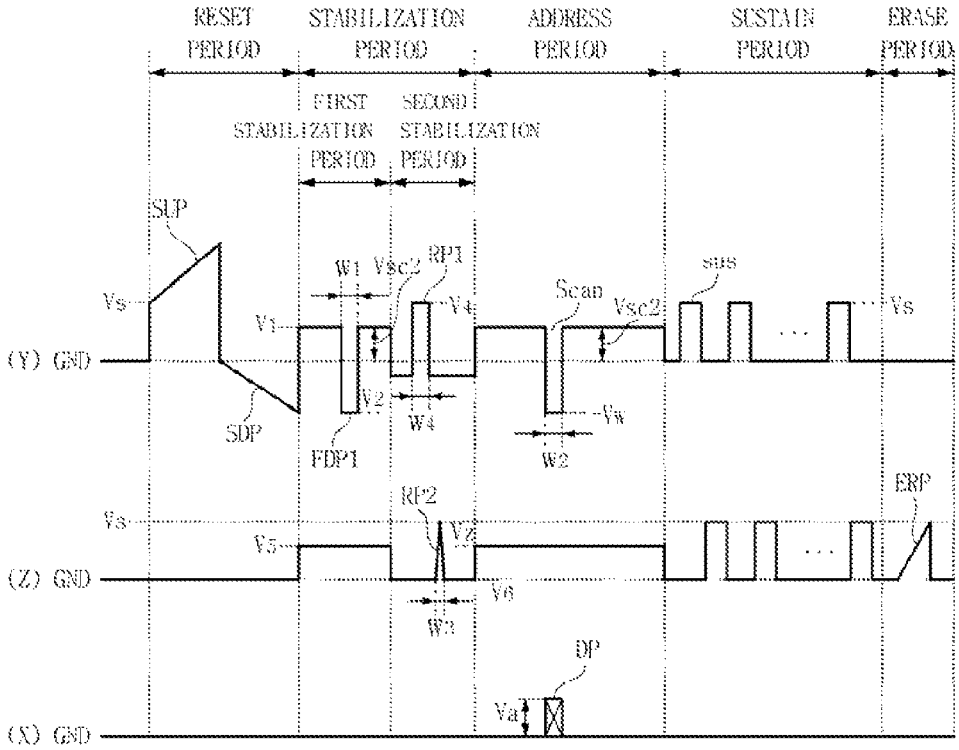
FIG. 9 illustrates a fifth waveform of the driving signal of the plasma display apparatus according to an embodiment of this document.

A fifth waveform of FIG. 9 is the same as the fourth waveform of FIG. 7 in the reset period, the sustain period, and the erase period.

The level of the first voltage V1 of the first falling pulse FDP1 shown in FIG. 9 is substantially the same as that of the scan reference voltage Vsc2 of a positive polarity. The level of the first voltage V1 may be in the range of 50V to 80V. The level of the second voltage V2 of the first falling pulse FDP1 may be from −70V or higher to −40V or less. The level of the third voltage V3 of the first rising pulse RP1 may be from −10V or higher to 10V or less. The second rising pulse RP2 of FIG. 9 is the same as the second rising pulse RP2 of FIG. 7, and thus will not be described.

Figure 10:
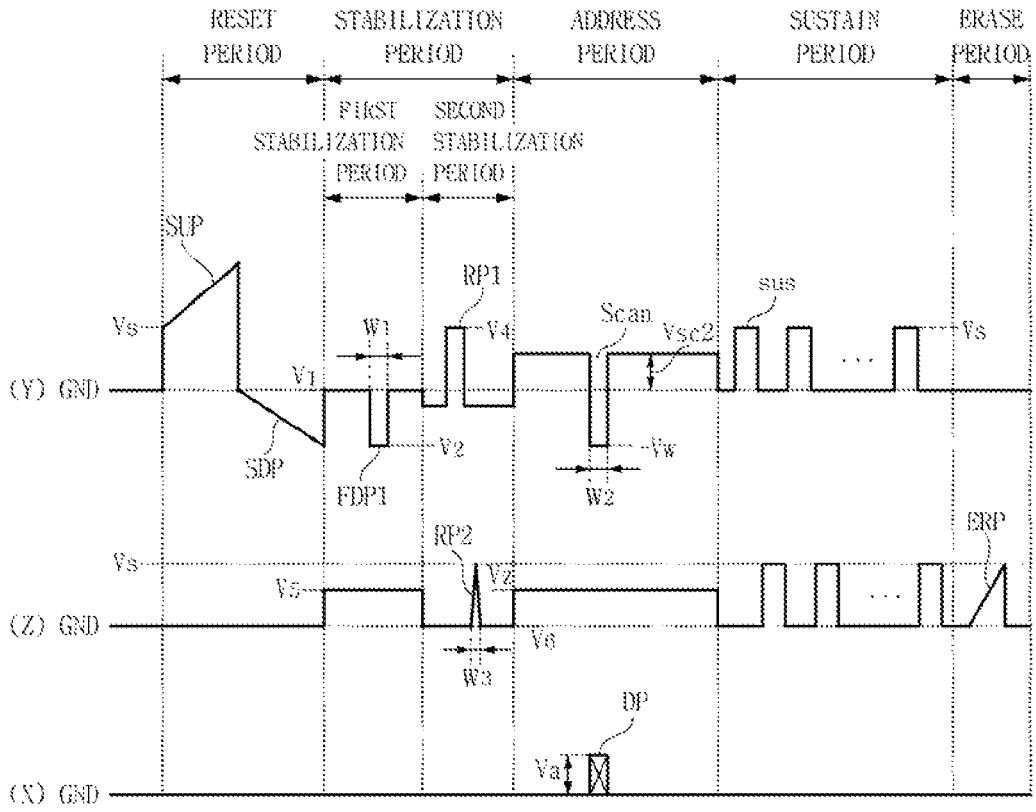
FIG. 10 illustrates a sixth waveform of the driving signal of the plasma display apparatus according to an embodiment of this document.

A sixth waveform of FIG. 10 is the same as the fourth waveform of FIG. 7 in the reset period, the sustain period, and the erase period.

The level of the first voltage V1 of the first falling pulse FDP1 shown in FIG. 10 may be from −10V or higher to 10V or less. The level of the second voltage V2 of the first falling pulse FDP1 may be from −70V or higher to −40V or less. The level of the third voltage V3 of the first rising pulse RP1 may be from −10V or higher to 10V or less.

Figure 11:
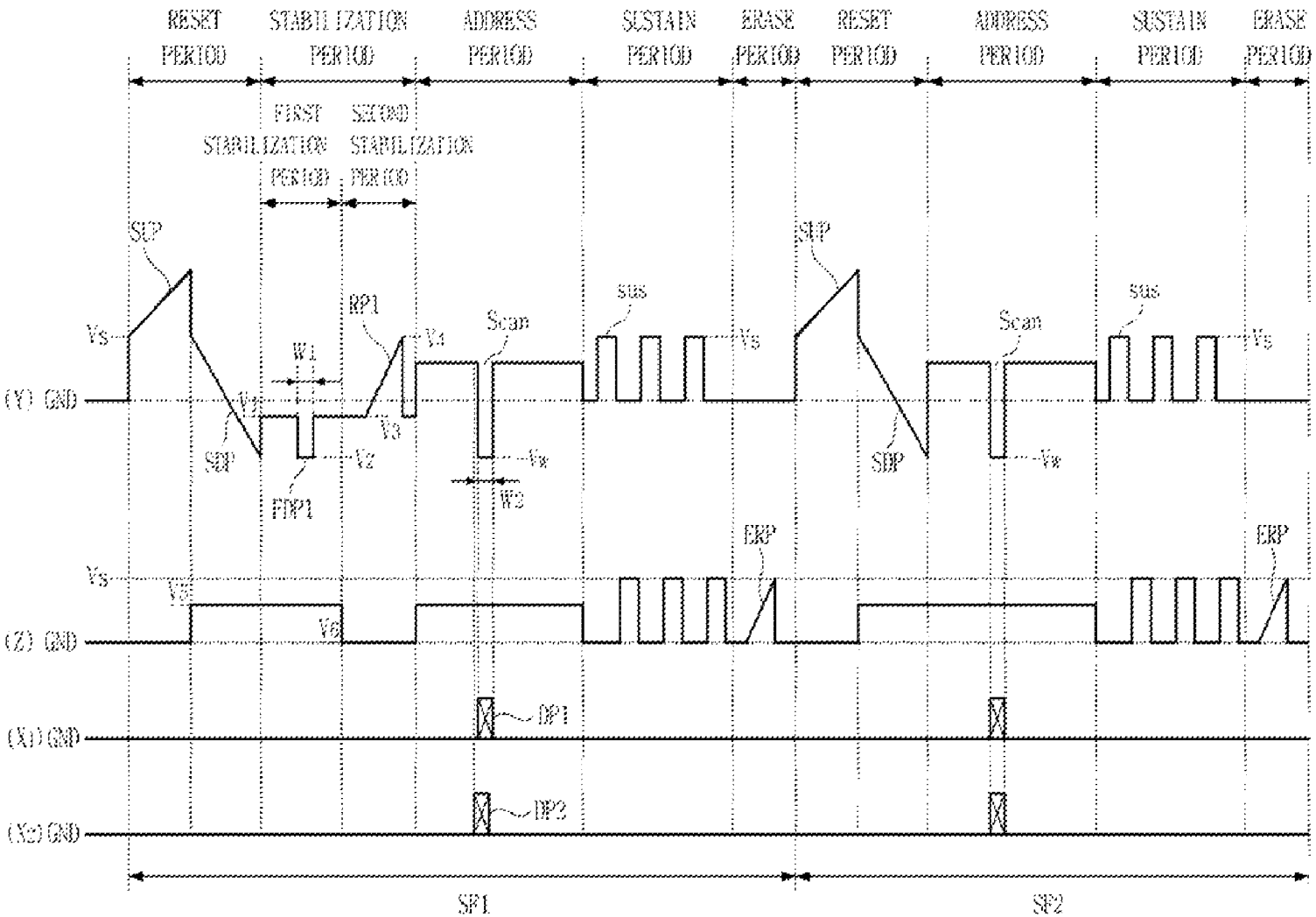
FIG. 11 illustrates a seventh waveform of the driving signal of the plasma display apparatus according to an embodiment of this document.

Waveforms in the reset period, the sustain period, and the erase period of FIG. 11 are the same as those of FIG. 4*a*, and thus will not be described in detail. Furthermore, waveforms in the first stabilization period and the second stabilization period of FIG. 11 are the same as those of FIG. 4*a*, but may be the same as those of FIG. 5 to those of FIG. 10.

As illustrated in FIG. 11, the data driver 150 supplies data pulses to a first address electrode group and a second address electrode group at different points of time in the address period of at least one of subfields of a frame. For example, the data driver 150 can supply data pulses DP1 and DP2 to the first address electrode group and the second address electrode group at different points of time in the address period of a subfield SF1 and can supply the data pulses DP1 and DP2 to the first address electrode group and the second address electrode group at the same point of time in the address period of a subfield SF2. The first address electrode group and the second address electrode group are different electrode groups. The first address electrode group comprises a first address electrode X1, and the second address electrode group comprises a second address electrode X2. The first address electrode group and the second address electrode group comprise one or more address electrodes.

The data pulse supplied in the address period of FIG. 11 is described in detail below with reference to FIGS. 12*a* to 14*c*.

Figure 12A:
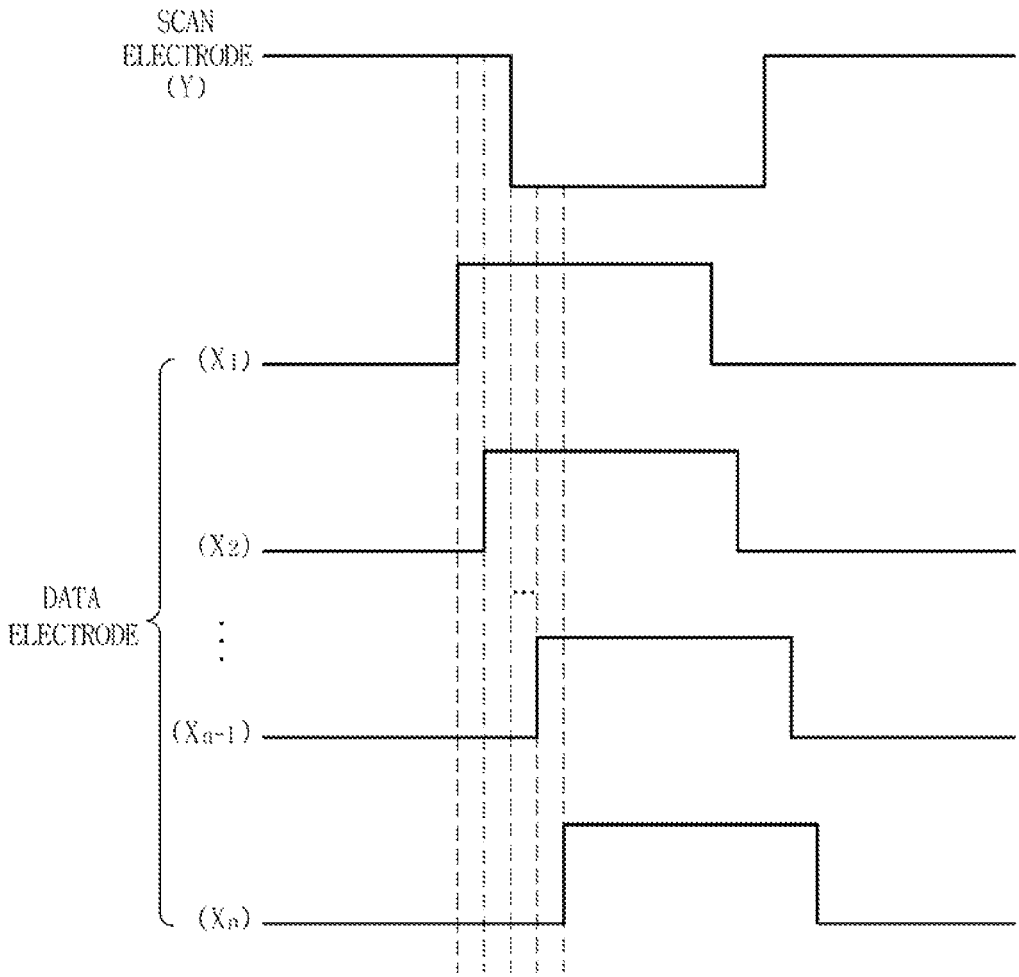
FIGS. 12*a* to 12*c* illustrate supply points of time of a data pulse and a scan pulse.

As illustrated in FIG. 12*a*, the data driver 150 sequentially supplies the data pulses to the address electrodes X1 to Xn at points of time anterior to a point of time at which the scan pulse is applied to the scan electrode Y in accordance with a disposition sequence of the address electrodes X1 to Xn. Accordingly, the data pulse of the address electrode X1 is supplied at the beginning, and the data pulse of the address electrode Xn is finally supplied. Further, the supply points of time of data pulses of some of the entire address electrodes X1 to Xn are earlier than the supply point of time of the scan pulse.

Figure 12B:
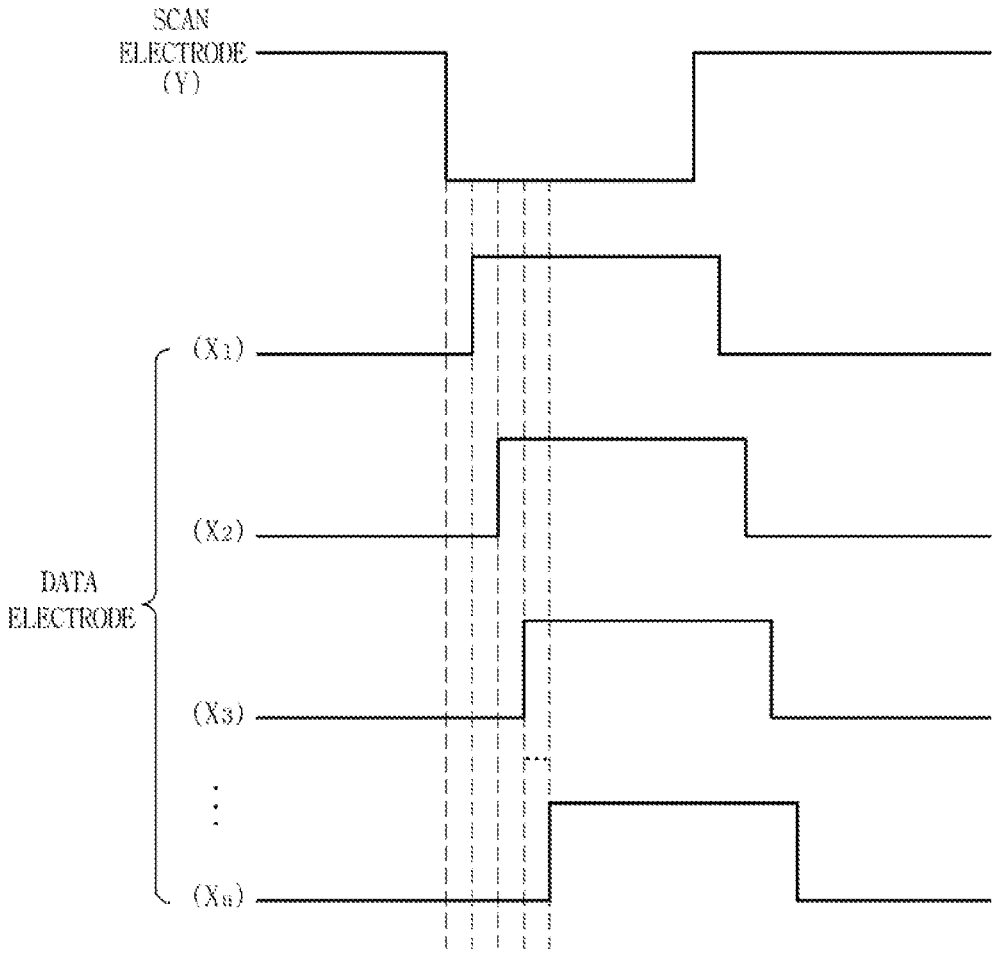

As illustrated in FIG. 12*b*, the data driver 150 sequentially supplies the data pulses to the address electrodes X1 to Xn at points of time posterior to a point of time at which the scan pulse is applied to the scan electrode Y in accordance with a disposition sequence of the address electrodes X1 to Xn. Accordingly, the data pulse of the address electrode X1 is supplied at the beginning, and the data pulse of the address electrode Xn is finally supplied. Further, the supply points of time of data pulses of some of the entire address electrodes X1 to Xn are later than the supply point of time of the scan pulse.

Figure 12C:
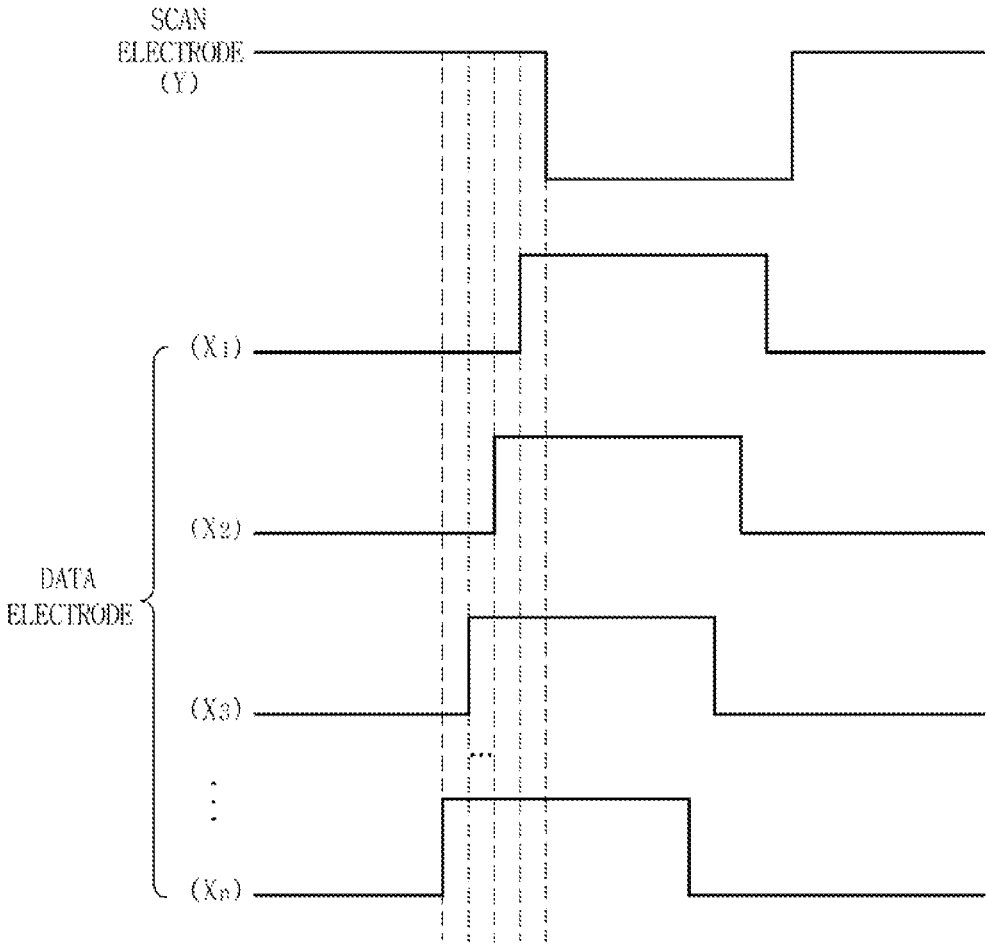

As illustrated in FIG. 12*c*, the data driver 150 sequentially supplies the data pulses to the address electrodes X1 to Xn at points of time anterior to a point of time at which the scan pulse is applied to the scan electrode Y in accordance with a reverse disposition sequence of the address electrodes X1 to Xn. Accordingly, the data pulse of the address electrode Xn is supplied at the beginning, and the data pulse of the address electrode X1 is finally supplied. Further, the supply points of time of data pulses of some of the entire address electrodes X1 to Xn are earlier than the supply point of time of the scan pulse.

A difference between the points of time of the data pulses supplied to the address electrodes shown in FIGS. 12*a* to 12*c* is substantially the same. For example, a difference between the supply point of time of the data pulse to the address electrode X1 and the supply point of time of the data pulse to the address electrode X2 can be substantially the same as that between the supply point of time of the data pulse to the address electrode Xn−1 and the supply point of time of the data pulse to the address electrode Xn. In a similar way, a difference between the supply points of time of the data pulses to the address electrodes may differ from each other.

Figure 13A:
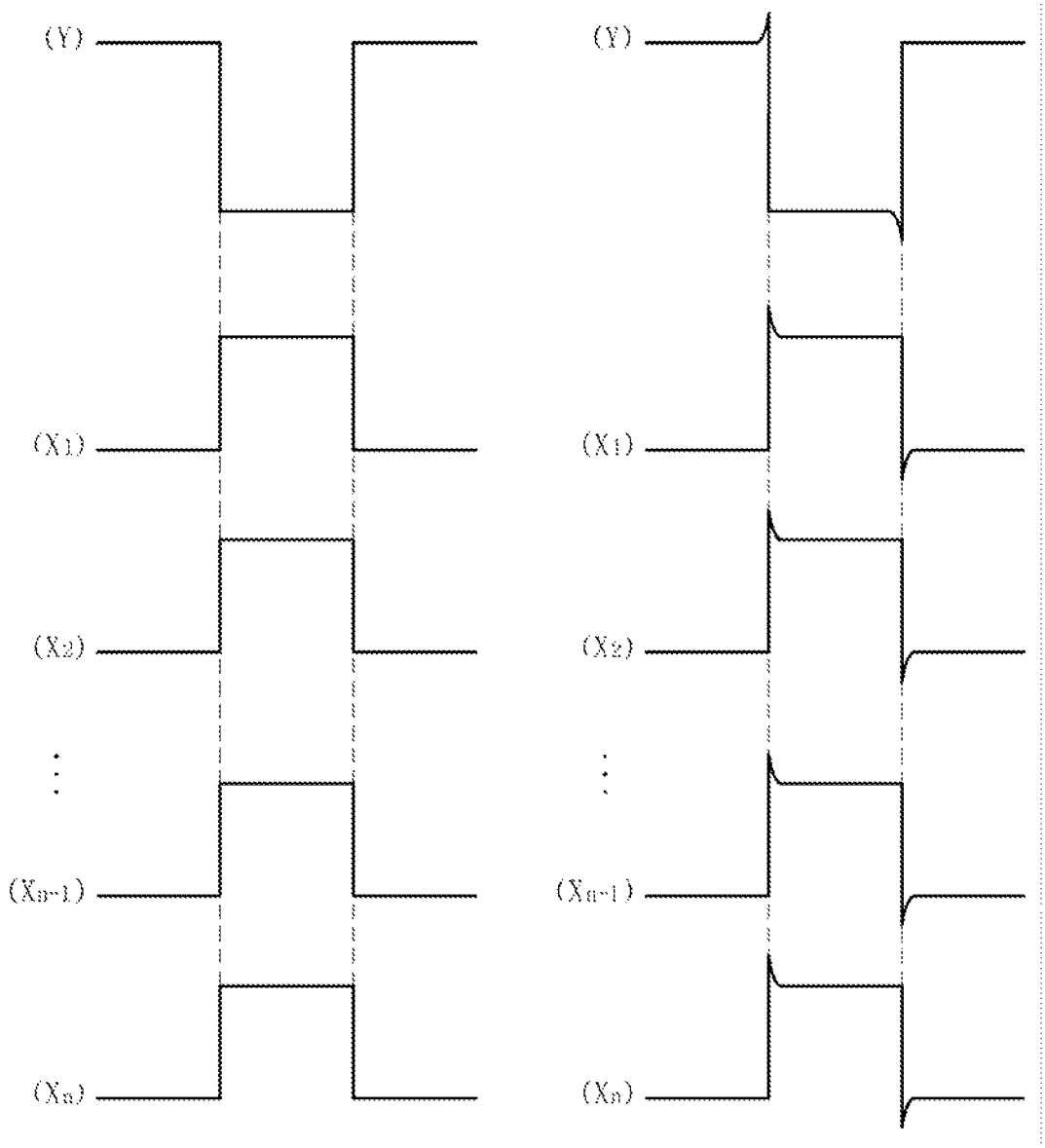
FIGS. 13*a* and 13*b* are views illustrating the influence of a data pulse and a scan pulse supplied at different points of time.
Figure 13B:
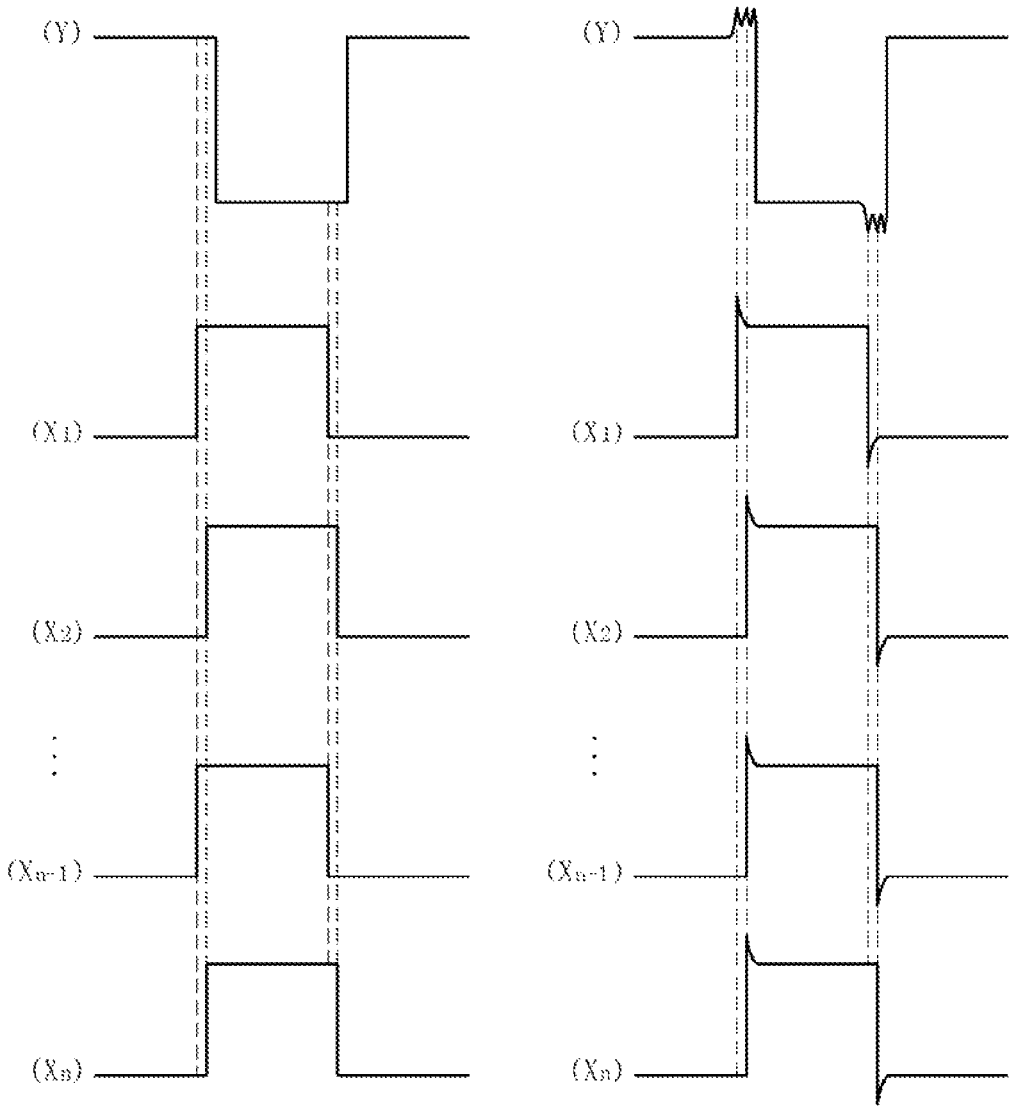

If the data pulse and the scan pulse are supplied at the same time as illustrated on a left side of FIG. 13*a*, coupling is increased due to capacitance between the address electrodes X1 to Xn and the scan electrode Y, generating great noise, as illustrated on a right side of FIG. 13*a*. However, if the data pulse and the scan pulse are supplied at different points of time as illustrated on a left side of FIG. 13*b*, coupling is decreased due to capacitance between the address electrodes X1 to Xn and the scan electrode Y, reducing great noise, as illustrated on a right side of FIG. 13*b*.

Consequently, a single scan method of scanning the whole plasma display panel by using one scan driver can be applied by stabilizing the address discharge of the plasma display apparatus.

Figure 14A:
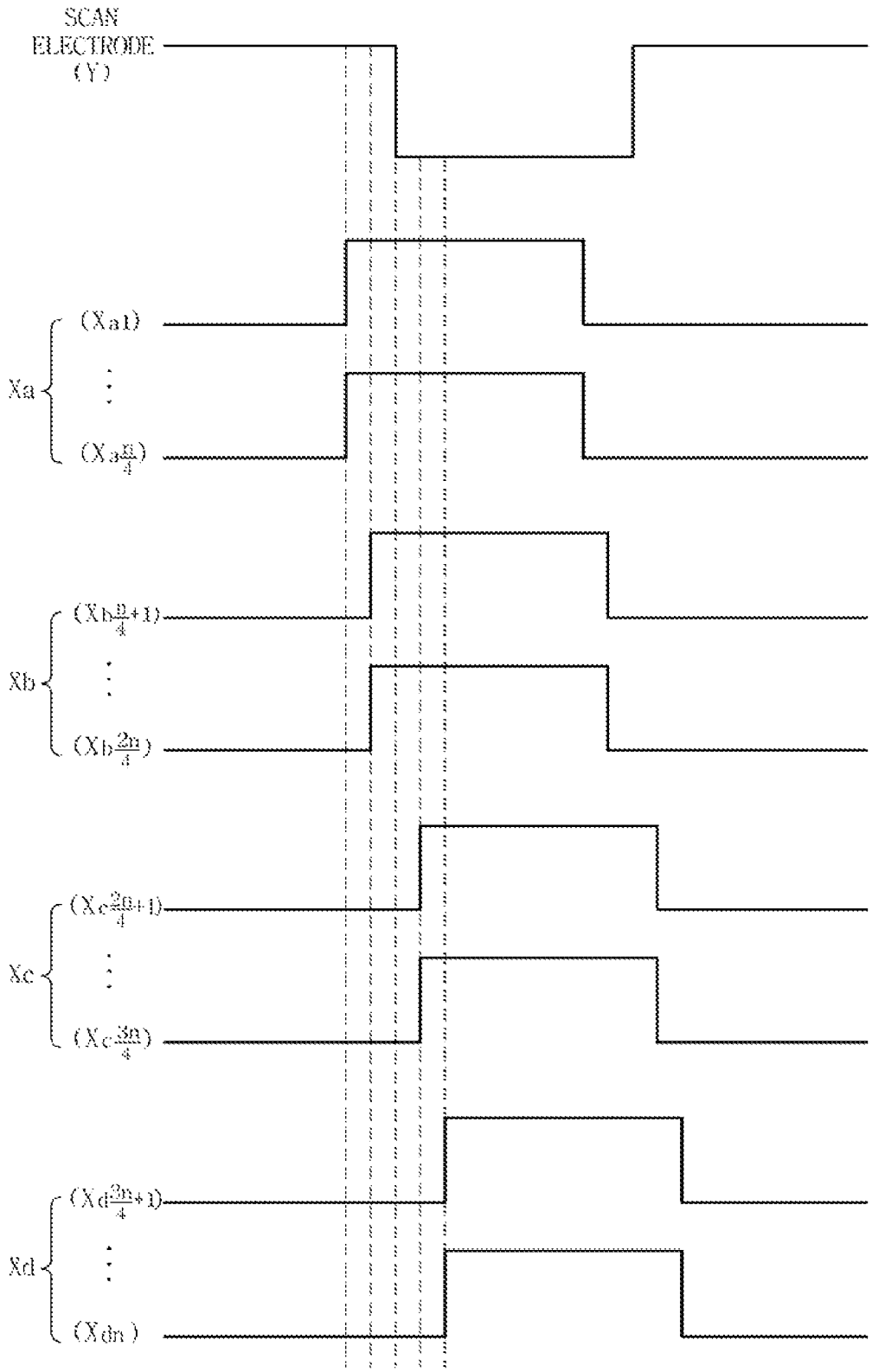
FIGS. 14*a* to 14*c* illustrate supply points of time of a data pulse and a scan pulse supplied to an address electrode group.
Figure 14B:
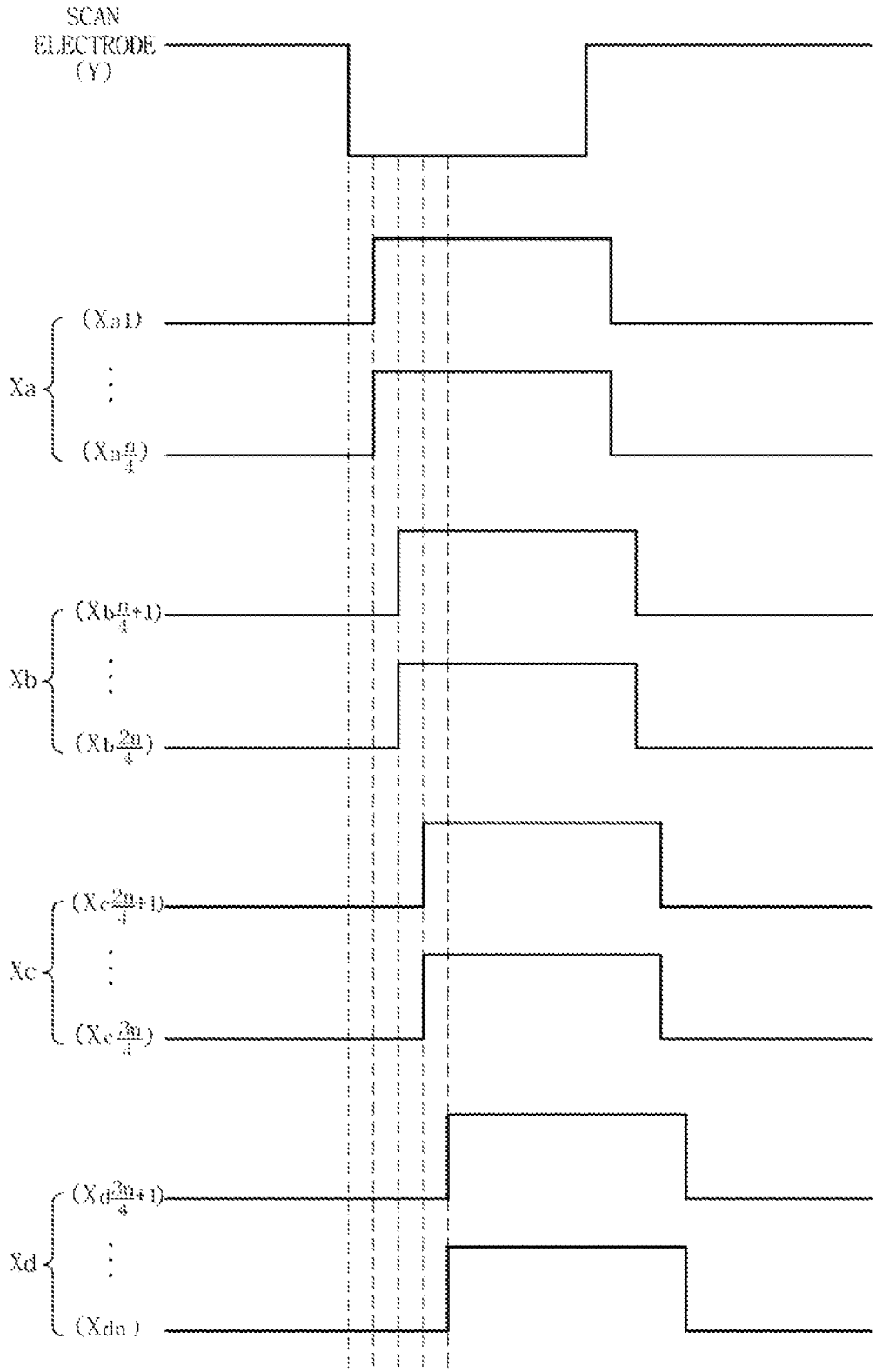
Figure 14C:
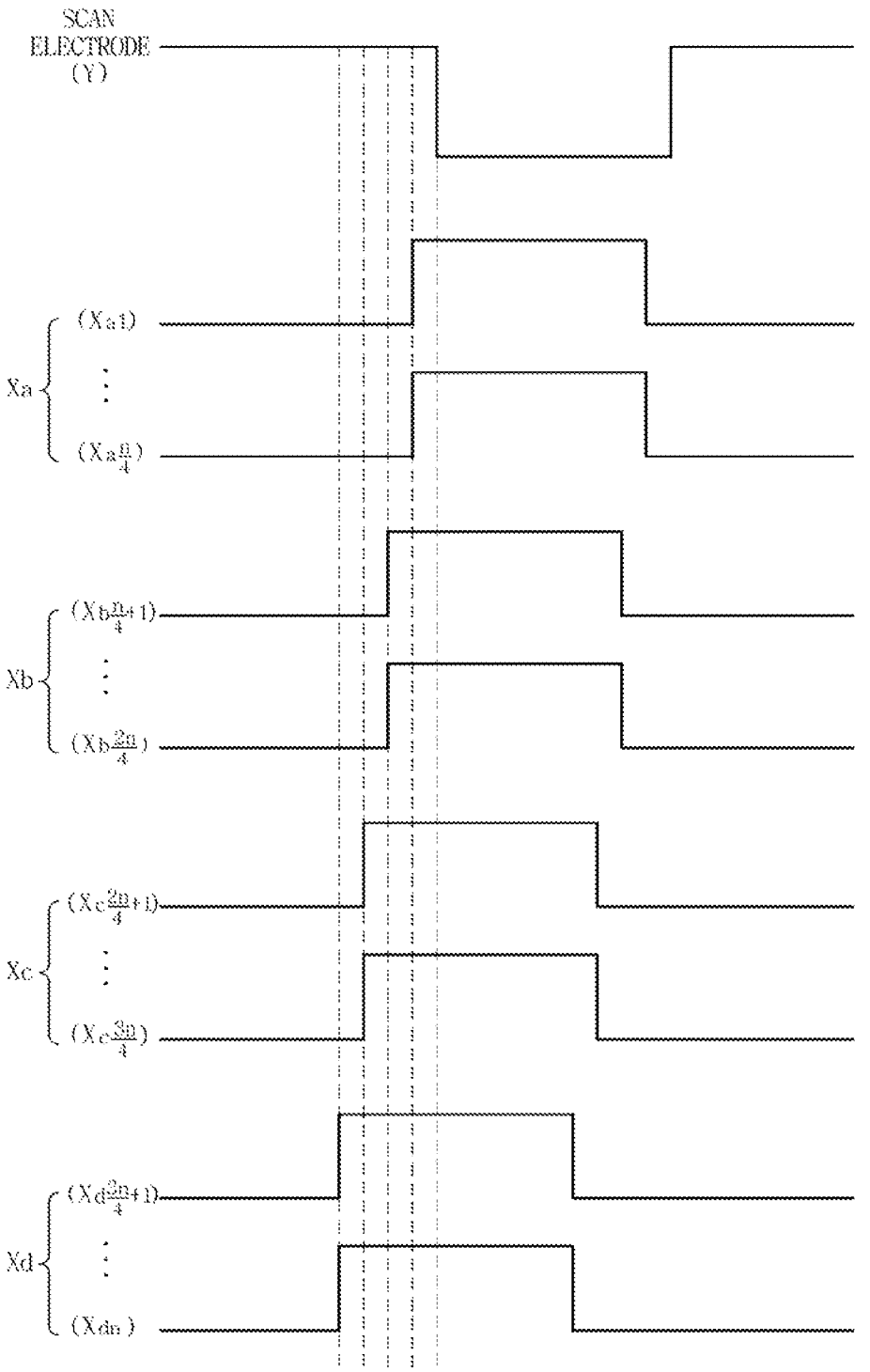

As illustrated in FIGS. 14*a* to 14*c*, the data driver 150 supplies data pulses to address electrode groups Xa, Xb, Xc, and Xd at different points of time from a point of time at which a scan pulse is supplied to the scan electrode. Alternatively, the supply points of time of data pulses to address electrodes comprised in the same address electrode group may be the same.

As illustrated in FIG. 14*a*, the data driver 150 sequentially supplies the data pulses to the address electrode groups Xa, Xb, Xc, and Xd at points of time anterior to a point of time at which the scan pulse is applied to the scan electrode Y in accordance with a disposition sequence of the address electrode groups Xa, Xb, Xc, and Xd. Accordingly, the data pulse of the address electrode group Xa is supplied at the beginning, and the data pulse of the address electrode group Xd is finally supplied. Furthermore, the supply points of time of the data pulses to the address electrode groups Xa and Xb of the entire address electrode groups Xa, Xb, Xc, and Xd are earlier than the supply point of time of the scan pulse.

As illustrated in FIG. 14*b*, the data driver 150 sequentially supplies the data pulses to the address electrode groups Xa, Xb, Xc, and Xd at points of time posterior to a point of time at which the scan pulse is applied to the scan electrode Y in accordance with a disposition sequence of the address electrode groups Xa, Xb, Xc, and Xd. Accordingly, the data pulse of the address electrode group Xa is supplied at the beginning, and the data pulse of the address electrode group Xd is finally supplied. Furthermore, the supply points of time of the data pulses to the entire address electrode groups Xa, Xb, Xc, and Xd are later than the supply point of time of the scan pulse.

As illustrated in FIG. 14*c*, the data driver 150 sequentially supplies the data pulses to the address electrode groups Xa, Xb, Xc, and Xd at points of time anterior to a point of time at which the scan pulse is applied to the scan electrode Y in accordance with a reverse disposition sequence of the address electrode groups Xa, Xb, Xc, and Xd. Accordingly, the data pulse of the address electrode group Xd is supplied at the beginning, and the data pulse of the address electrode group Xa is finally supplied. Further, the supply points of time of the data pulses to the entire address electrode groups Xa, Xb, Xc, and Xd are earlier than the supply point of time of the scan pulse.

If the supply point of time of the scan pulse applied to the scan electrode Y is different from the supply point of time of the data pulse supplied to each address electrode group, coupling is reduced, decreasing noise.

As described above, if the falling pulse, the first rising pulse, and the second rising pulse are supplied in the first stabilization period and the second stabilization period, stable address discharge is generated. Further, if the supply point of time of the data pulse is different from that of the scan pulse, the widths of the data pulse and the scan pulse can be reduced. Therefore, not only the sustain period can be prevented from decreasing due to the first stabilization period and the second stabilization period, but also noise can be prevented from increasing.

Figure 15:
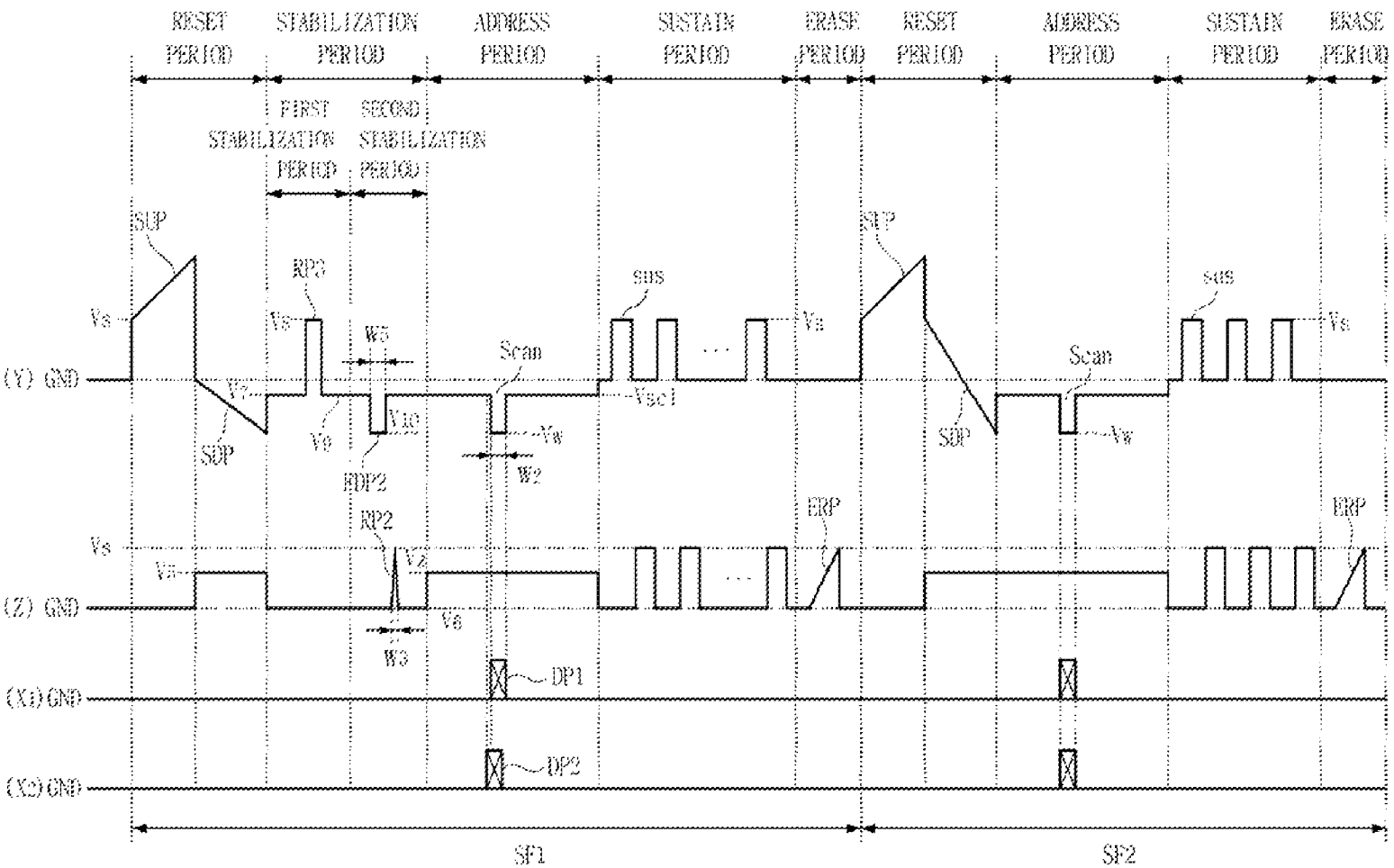
FIG. 15 illustrates an eighth waveform of the driving signal of the plasma display apparatus according to an embodiment of this document.

As illustrated in FIG. 15, the scan driver 110 of FIG. 1 supplies the set-up pulse SUP, rising from the sustain voltage Vs, and the set-down pulse SDP, falling from voltage of a ground level GND, to the scan electrode Y in the reset period. The set-up pulse SUP causes weak dark discharge to occur within discharge cells. The set-up pulse SUP causes positive wall charges to be accumulated on the address electrode X and the sustain electrode Z and negative wall charges to be accumulated on the scan electrode Y. The set-down pulse SDP causes erase discharge to be generated between the scan electrode Y and the address electrode X. The sustain driver 120 of FIG. 1 supplies the bias voltage Vz to the sustain electrode Z while the set-down pulse SDP is supplied.

The scan driver 110 supplies a third rising pulse RP3, rising from a seventh voltage V7 to an eighth voltage V8, to the scan electrode Y in the first stabilization period, and supplies a second falling pulse FDP2, falling from a ninth voltage V9 to a tenth voltage V10, to the scan electrode Y in the second stabilization period. The sustain driver 120 supplies voltage of a ground level to the sustain electrode Z while the third rising pulse RP3 and the second falling pulse FDP2 are supplied.

The third rising pulse RP3 of FIG. 15 performs the same function as that of the first rising pulse RP1 of FIG. 7. In other words, the third rising pulse RP3 makes uniform wall charges formed on the scan electrode Y and the address electrode X of each discharge cell. The second falling pulse FDP2 supplied posterior to the third rising pulse RP3 performs the same function as that of the first falling pulse RP1 of FIG. 7. That is, the second falling pulse FDP2 causes some amount of wall charges formed between the scan electrode Y and the sustain electrode Z to be erased.

The level of the seventh voltage V7 may be substantially the same as that of the scan reference voltage −Vsc1. The level of the scan reference voltage −Vsc1 may be from −90V or higher to −70V or less. The level of the eighth voltage V8 may be substantially the same as that of the highest voltage Vs of the sustain pulse Sus. In an embodiment of this document, the level of the seventh voltage V7 may be in the range of 150V to 250V.

The level of the ninth voltage V9 of the second falling pulse FDP2 may be substantially the same as that of the scan reference voltage −Vsc1 applied to the scan electrode Y during the address period. The level of the tenth voltage V10 of the second falling pulse FPD2 may be substantially the same as that of the lowest voltage −Vw of the scan pulse Scan supplied to the scan electrode Y during the address period. The level of the tenth voltage V10 of the second falling pulse FDP2 may be from −210V or higher to −190V or less. A width w5 of the second falling pulse FDP2 may be substantially the same as or greater than that the width w2 of the scan pulse Scan. The width w5 of the second falling pulse may be in the range of 1 μs to 10 μs. Since the second rising pulse RP2 has been described above, a description is omitted.

The data driver 150 supplies the data pulses to the first address electrode group and the second address electrode group at different points of time in the address period of at least one of subfields of a frame. For example, the data driver 150 can supply the data pulses DP1 and DP2 to the first address electrode group and the second address electrode group at different points of time in the address period of a subfield SF1, and can supply the data pulses DP1 and DP2 to the first address electrode group and the second address electrode group at the same time in the address period of a subfield SF2. The first address electrode group and the second address electrode group are different electrode groups. The first address electrode group comprises the first address electrode X1, and the second address electrode group comprises the second address electrode X2. The first address electrode group and the second address electrode group comprise one or more address electrodes.

Not only the data pulses supplied in the address period of FIG. 15, but also the data pulses shown in FIGS. 12*a* to 12*c* and FIGS. 14*a* to 14*c* can be supplied.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel comprising a scan electrode, a sustain electrode, a first address electrode, and a second address electrode, the plasma display panel being adapted to generate plasma to display an image;

a scan driver for supplying a pulse to the scan electrode between a reset period and an address period; and a data driver for supplying a data pulse to the first address electrode and the second address electrode at different points of time.

2. The plasma display apparatus of claim 1, wherein the pulse is a first falling pulse falling from a first voltage to a second voltage of a negative polarity, and the plasma display apparatus further comprises a sustain driver for supplying a fifth voltage of a positive polarity to the sustain electrode when the first falling pulse is supplied.

3. The plasma display apparatus of claim 1, wherein the pulse is a first falling pulse falling from a first voltage to a second voltage of a negative polarity, and the scan driver is adapted to supply a first rising pulse, which gradually rises from a third voltage to a fourth voltage, to the scan electrode after the first falling pulse is supplied.

4. The plasma display apparatus of claim 2, wherein the scan driver is adapted to supply a first rising pulse, which gradually rises from a third voltage to a fourth voltage, to the scan electrode after the first falling pulse is supplied, the plasma display apparatus further comprises a sustain driver for supplying the fifth voltage to the sustain electrode while the first falling pulse is supplied and supplying a sixth voltage to the sustain electrode while the first rising pulse is supplied, and a level of the fifth voltage is higher than a level of the sixth voltage.

5. The plasma display apparatus of claim 1, wherein the pulse is a first falling pulse falling from a first voltage to a second voltage of a negative polarity, the scan driver is adapted to supply a first rising pulse, which gradually rises from a third voltage to a fourth voltage, to the scan electrode after the first falling pulse is supplied, and is adapted to supply a scan reference voltage to the scan electrode in the address period, and a level of the third voltage is substantially same as a level of the scan reference voltage.

6. The plasma display apparatus of claim 1, wherein the pulse is a third rising pulse rising from a seventh voltage to an eighth voltage.

7. The plasma display apparatus of claim 1, wherein the pulse is a third rising pulse rising from a seventh voltage to an eighth voltage, and the scan driver is adapted to supply a second falling pulse, which falls from a ninth voltage to a tenth voltage, to the scan electrode after the third rising pulse is supplied.

8. The plasma display apparatus of claim 1, wherein the pulse is a third rising pulse rising from a seventh voltage to an eighth voltage, the scan driver is adapted to supply a scan reference voltage to the scan electrode in the address period, and a level of the seventh voltage is substantially same as a level of the scan reference voltage.

9. The plasma display apparatus of claim 1, wherein the pulse is a third rising pulse rising from a seventh voltage to an eighth voltage, the scan driver is adapted to supply a sustain pulse to the scan electrode in a sustain period, and a level of the eighth voltage is substantially same as a level of a highest voltage of the sustain pulse.

10. The plasma display apparatus of claim 1, wherein the pulse is a third rising pulse rising from a seventh voltage to an eighth voltage, the scan driver is adapted to supply a second falling pulse, which falls from a ninth voltage to a tenth voltage, to the scan electrode after the third rising pulse is supplied, and is adapted to supply a scan pulse to the scan electrode in the address period, and a width of the second falling pulse is substantially same as or greater than a width of the scan pulse.

11. A method of driving a plasma display apparatus comprising a scan electrode, a sustain electrode, a first address electrode, and a second address electrode, the plasma display apparatus being adapted to generate plasma to display an image, the method comprising:

supplying a pulse to the scan electrode between a reset period and an address period; and supplying a data pulse to a first address electrode and a second address electrode at different points of time in the address period.

12. The method of claim 11, wherein the pulse is a first falling pulse falling from a first voltage to a second voltage of a negative polarity, and when the first falling pulse is supplied, a fifth voltage of a positive polarity is supplied to the sustain electrode.

13. The method of claim 11, wherein the pulse is a first falling pulse falling from a first voltage to a second voltage of a negative polarity, and after the first falling pulse is supplied, a first rising pulse, which gradually rises from a third voltage to a fourth voltage, is supplied to the scan electrode.

14. The method of claim 12, wherein after the first falling pulse is supplied, a first rising pulse, which gradually rises from a third voltage to a fourth voltage, is supplied to the scan electrode, the fifth voltage is supplied to the sustain electrode while the first falling pulse is supplied, and a sixth voltage is supplied to the sustain electrode while the first rising pulse is supplied, and a level of the fifth voltage is higher than a level of the sixth voltage.

15. The method of claim 11, wherein the pulse is a first falling pulse falling from a first voltage to a second voltage of a negative polarity, a first rising pulse, which gradually rises from a third voltage to a fourth voltage, is supplied to the scan electrode after the first falling pulse is supplied, and a scan reference voltage is supplied to the scan electrode in the address period, and a level of the third voltage is substantially same as a level of the scan reference voltage.

16. The method of claim 11, wherein the pulse is a third rising pulse rising from a seventh voltage to an eighth voltage.

17. The method of claim 11, wherein the pulse is a third rising pulse rising from a seventh voltage to an eighth voltage, and after the third rising pulse is supplied, a second falling pulse, which falls from a ninth voltage to a tenth voltage, is supplied to the scan electrode.

18. The method of claim 11, wherein the pulse is a third rising pulse rising from a seventh voltage to an eighth voltage, a scan reference voltage is supplied to the scan electrode in the address period, and a level of the seventh voltage is substantially same as a level of the scan reference voltage.

19. The method of claim 11, wherein the pulse is a third rising pulse rising from a seventh voltage to an eighth voltage, a sustain pulse is supplied to the scan electrode in a sustain period, and a level of the eighth voltage is substantially same as a level of a highest voltage of the sustain pulse.

20. The method of claim 11, wherein the pulse is a third rising pulse rising from a seventh voltage to an eighth voltage, a second falling pulse, which falls from a ninth voltage to a tenth voltage, is supplied to the scan electrode after the third rising pulse is supplied, and a scan pulse is supplied to the scan electrode in the address period, and a width of the second falling pulse is substantially same as or greater than a width of the scan pulse.

* * * * *